US010188196B2

(12) United States Patent
Thibadeau

(10) Patent No.: US 10,188,196 B2
(45) Date of Patent: Jan. 29, 2019

(54) BACK PACK WITH RAIN COVER

(71) Applicant: Thule IP AB, Malmö (SE)

(72) Inventor: Mark Thibadeau, Boulder, CO (US)

(73) Assignee: Thule IP AB, Malmö (SE)

( * ) Notice: Subject to any disclaimer, the term of this patent is extended or adjusted under 35 U.S.C. 154(b) by 108 days.

(21) Appl. No.: 14/724,512

(22) Filed: May 28, 2015

(65) Prior Publication Data

US 2016/0345711 A1 Dec. 1, 2016

(51) Int. Cl.
*A45F 3/04* (2006.01)
*A45F 3/00* (2006.01)

(52) U.S. Cl.
CPC ..... *A45F 3/04* (2013.01); *A45F 2003/001* (2013.01); *A45F 2003/003* (2013.01)

(58) Field of Classification Search
CPC ..... Y10T 24/3689; A44B 1/18; A44B 1/22; A44B 1/24; A45F 3/00–3/08; A45F 2003/001
USPC ..... 224/576; 150/159, 105
See application file for complete search history.

(56) References Cited

U.S. PATENT DOCUMENTS 5,439,153 A * 8/1995 Murdoch ..... A45C 13/002 150/159
5,452,476 A * 9/1995 Jenks ..... A41D 3/00 2/108
5,676,295 A * 10/1997 Gelb ..... A45F 3/04 224/628
5,718,333 A * 2/1998 Armour ..... A63B 55/404 150/159
6,138,881 A * 10/2000 Paul ..... A45F 3/02 224/153
6,742,635 B2 * 6/2004 Hirshberg ..... A45C 9/00 190/2
D509,653 S * 9/2005 Yu ..... D3/216
8,453,896 B1 * 6/2013 Mansell ..... A45C 3/001 206/287
9,427,058 B2 * 8/2016 Boglione ..... A45C 5/03
2004/0238021 A1 * 12/2004 Holub ..... E04H 15/18 135/97
2006/0201981 A1 * 9/2006 Meyer ..... A45F 3/04 224/628
2011/0061151 A1 * 3/2011 Chang ..... A41D 13/11 2/424

(Continued)

OTHER PUBLICATIONS

"Thule Capstone 40L Men's Hiking Pack," http://www.thule.com/en-us/us/products/sport-and-travel-bags/technical-backpacks/hiking-backpacks/thule-capstone-401-mens-hiking-pack-_-tb_40_m_206804, accessed May 28, 2015, 3 pages.

*Primary Examiner* — Justin Larson
(74) *Attorney, Agent, or Firm* — Sterne, Kessler, Goldstein & Fox P.L.L.C.

(57) ABSTRACT

A back pack with a rain cover is disclosed. The back pack comprises a front side facing away from a user and a back side facing towards the user when the back pack is carried. The back pack comprises a water proof base portion provided at the lower end of the back pack. The water proof base portion comprises at least an upwardly extending portion extending in a predetermined area on the front side of the back pack in a height direction of the back pack. The rain cover is adapted to cover only a part of the front side in a mounted state in such a way that at least portions of the back pack other than the water proof base portion are covered.

20 Claims, 7 Drawing Sheets

(56) References Cited

U.S. PATENT DOCUMENTS

| | | | | |
|---|---|---|---|---|
| 2012/0121210 | A1* | 5/2012 | Meyer | A45C 13/002 383/4 |
| 2016/0183666 | A1* | 6/2016 | Whitehill | A45F 3/02 224/578 |

* cited by examiner

BACK PACK WITH RAIN COVER

BACKGROUND

The present invention relates to a backpack comprising a rain cover and in particular to a back pack comprising a rain cover which is used to cover portions of said back pack which are not waterproof.

Back packs comprising rain covers are known in the art and typically comprise a compartment in which the rain cover is stored in a non-use condition. Known rain covers are typically constructed such that the back pack can be covered by the rain cover to the largest possible extent. In practical use, this means that the rain cover is constructed so as to cover the back pack in such a way that only a back portion of the back pack facing the user's back remains uncovered to a certain extent in case the rain cover is mounted on the back pack.

While such rain covers provide an acceptable solution for covering back packs against rain water, such rain covers have the drawback that they cover substantially all portions of the back pack thereby obstructing access to substantially all portions and compartments of the back pack. Thus, in case a user intends to reach objects carried in the back pack, it is necessary to first remove the rain cover so as to get access to these portions and compartments.

SUMMARY

Accordingly, it is the object of the present invention to provide a back pack in which the above mentioned drawback is eliminated.

This object is solved by a back pack comprising the features according to claim 1. Advantageous further developments are set out in the dependent claims.

According to the invention, the back pack comprises a front side facing away from a user when the back pack is carried, a back side facing towards the user when the back pack is carried and a waterproof base portion provided at the lower end of the back pack. The waterproof base portion at least comprises an upwardly extending portion extending in a predetermined area on the front side of the back pack in a height direction of the back pack. The back pack further comprises a rain cover adapted to cover only a part of the front side in a mounted state in such a way that at least portions of the back pack other than the waterproof base portion are covered.

Accordingly, a back pack is provided with a waterproof base portion allowing to use a rain cover which can be constructed in such a way that the waterproof base portion is not covered. This is due to the fact that the base portion is waterproof and consequently does not need to be covered by the rain cover. As the waterproof base portion of the back pack extends in a predetermined area on the front side of the back pack in a height direction of the back pack, all portions of the back pack provided in this predetermined area are not covered by the rain cover and consequently accessible without the need for removing the rain cover. For example, it is possible to construct the waterproof base portion in such a way that side pockets of the back pack, usually used to transport bottles or other items which should be advantageously reachable without taking the back pack off, are arranged in the predetermined area and consequently waterproof. Since the rain cover in the mounted state does not cover these portions, they are still accessible.

It is beneficial if the rain cover is adapted to cover the back pack such that the waterproof base portion is not covered or a majority of the waterproof base portion is not covered. By this, the size of the rain cover can be minimized and consequently the rain cover takes much less space when it is stored in a rain cover compartment.

Preferably, the predetermined area of the upwardly extending portion on the front side is at most one-fourth of the total height of the front side. By limiting the predetermined area, the weight-increase of the back pack due to the waterproof material used for the waterproof base portion is prevented.

The rain cover can be adapted to cover three-fourths of the front side of the back pack.

In a preferable construction, the back pack can further comprise a rain cover compartment, wherein an opening of the rain cover compartment is provided on the front side of the back pack at an upper end of the upwardly extending portion. By providing the rain cover compartment at such a position, it is possible to arrange the rain cover such that the waterproof base portion is covered as little as possible.

Preferably, the back pack further comprises rain cover fastening elements for coupling the rain cover to the back pack. At least two of the fastening elements can be first rain cover fastening elements provided in the rain cover compartment at a predetermined distance from each other in the lateral direction of the backpack. The rain cover can comprise first fastening elements provided at an edge of the rain cover at a distance from each other and can be engageable with the first rain cover fastening elements.

The rain cover can comprise a reinforcement portion extending between the first fastening elements along the edge of the rain cover. Preferably, the reinforcement portion can be provided by a reinforcement fabric sewn to the rain cover on a side facing towards the front side at the back pack when the rain cover is mounted on the back pack.

The reinforcement portion can comprise a reinforcement tab preferably made of plastic. The reinforcement tab can be provided substantially at the center of the reinforcement portion in an extension direction thereof and can protrude from the reinforcement portion in a lateral direction of the reinforcement portion. A protruding end of the reinforcement tab can be insertable into an opening provided in the front side of the back pack. Preferably, the opening is arranged outside a rain cover compartment and adjacent to an opening of the rain cover compartment.

The back pack can further comprise second rain cover fastening elements provided on the back side at laterally spaced portions of the back pack. And the rain cover can comprise second fastening elements engageable with the second rain cover fastening elements.

The fastening elements can comprise elements of a hook and loop fastener. Preferably, the fastening elements of the rain cover comprise hooks and the fastening elements on the back pack can comprise loops.

The rain cover can comprise a fastening device for mounting the rain cover. The fastening device can comprise an elastic strip fixed to an edge of the rain cover at one end and having a hook on the other end. A loop can be provided at another position of the rain cover edge. The elastic strip and the loop can be provided on the rain cover such that for fastening the rain cover on the back pack the elastic strip is laterally passable along the back side of the back pack and engageable with the hook.

DETAILED DESCRIPTION

In the following embodiments of the present subject matter will be described with reference to the figures. It is to be noted that equal or similar elements are denoted with the same reference signs.

Figure 1:
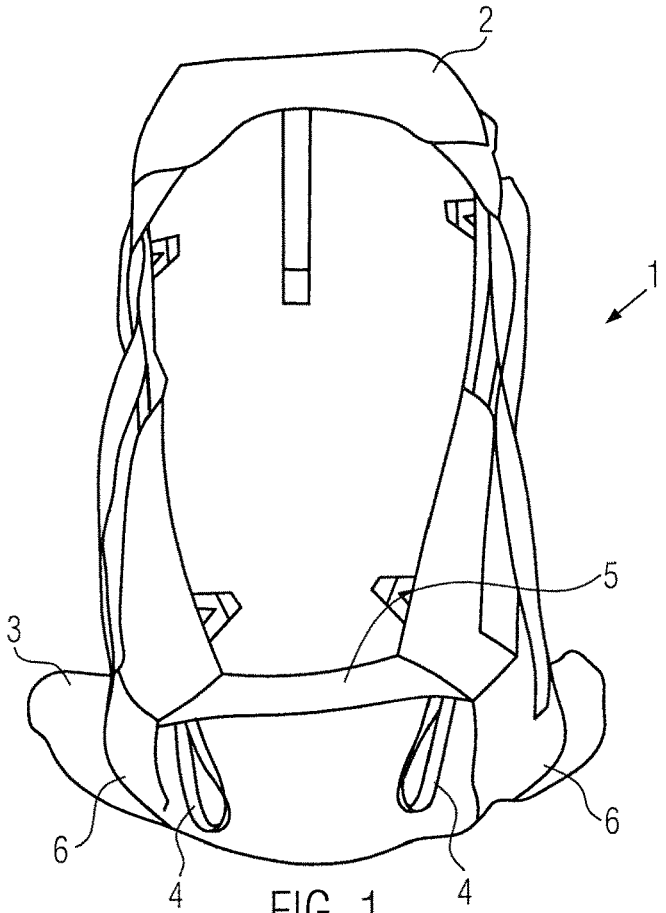
FIG. 1 shows a front side view of a back pack according to an embodiment of the present subject matter.

A back pack according to an embodiment of the present subject matter is shown in FIG. 1. More precisely, FIG. 1 shows a front side view of a back pack 1 which comprises a lid 2 for covering an opening of a main compartment of the back pack 1 on its upper end. Furthermore, the back pack 1 comprises a hip belt 3, two side pockets 6 as wells two ice axe loops 4 provided in the lower portion of the back pack 1. As is also shown in FIG. 1, the back pack 1 comprises a flap 5 covering a zipper of a rain cover compartment opening.

Figure 2:
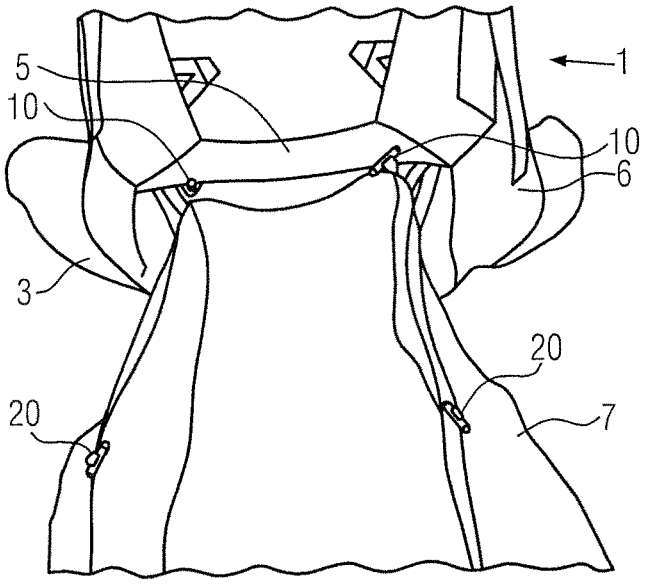
FIG. 2 shows a front side view of a lower portion of the back pack according to the present subject matter.

As is shown in FIG. 2, the back pack 1 further comprises a rain cover 7 which in a non-used state is accommodated in the rain cover compartment. In the state as shown in FIG. 2, the rain cover compartment is opened and the rain cover 7 is taken out of the compartment. The rain cover 7 is made of waterproof material provided in a bag shape with an opening which in the present case is formed by an elastic edge of the rain cover material. As is shown in FIG. 2, two hooks 10 are provided at a predetermined distance from each other on the edge of the rain cover 7 and these hooks 10 are engaged with mating loops 11 as provided in the rain cover compartment of the back pack 1. The hooks 10 and loops 11 are visible in FIG. 3.

As shown in the lower portion of FIG. 2, the rain cover 7 further comprises two hooks 20 which are used to fixedly mount the rain cover 7 on the back pack 1.

Figure 3:
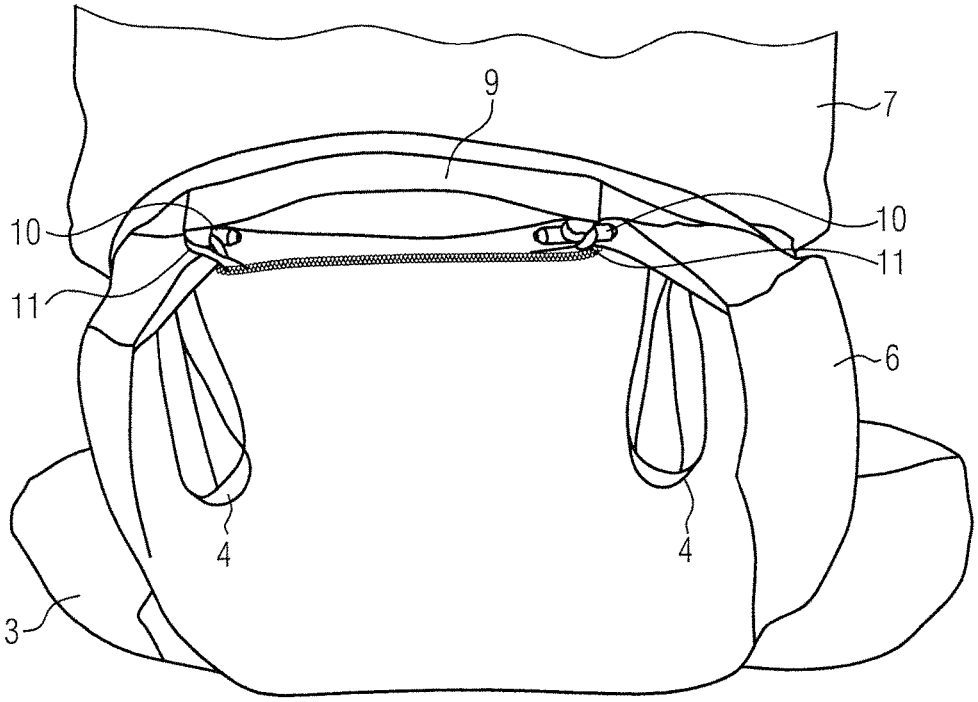
FIG. 3 shows a further front side view of the lower portion of the back pack according to the present subject matter.
Figure 4:
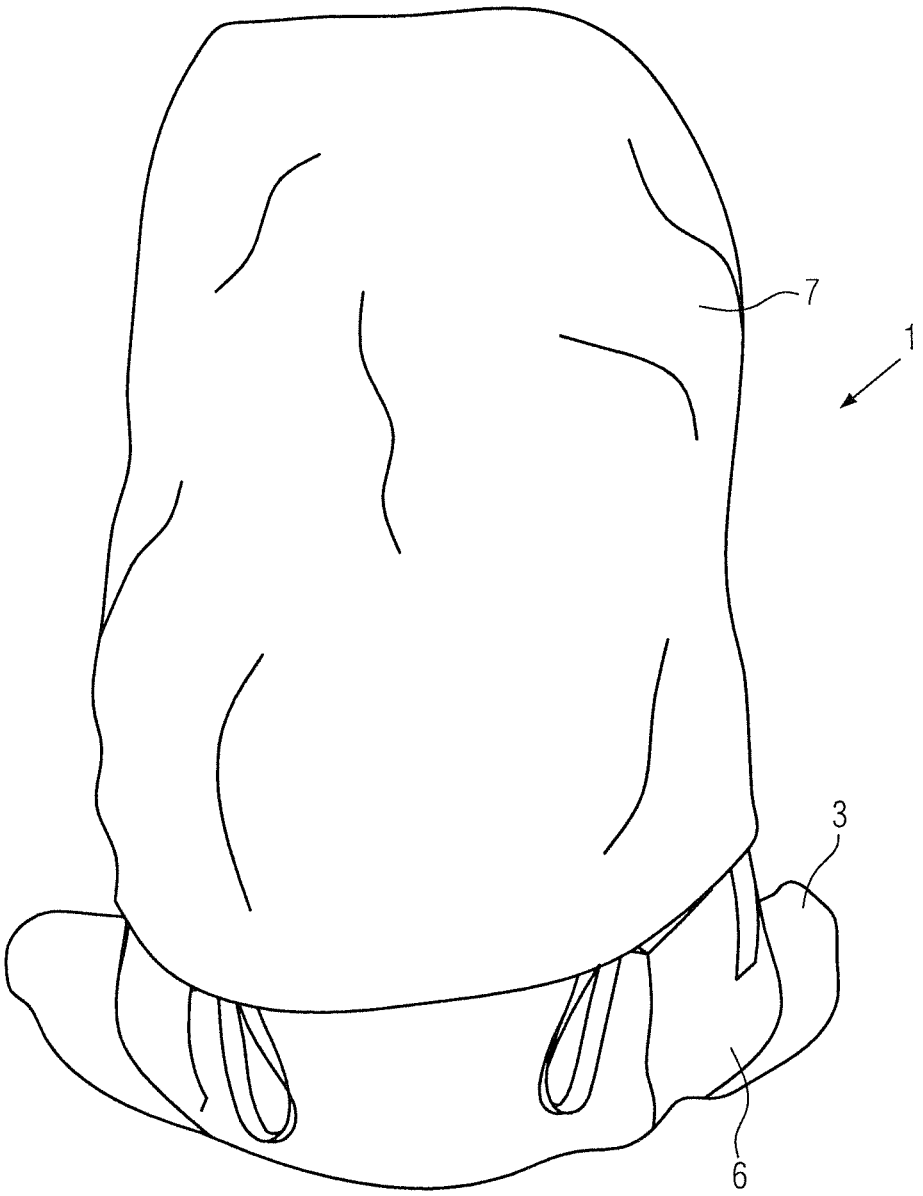
FIG. 4 shows a front side view of a back pack according to the present subject matter with a rain cover mounted thereon.
Figure 5:
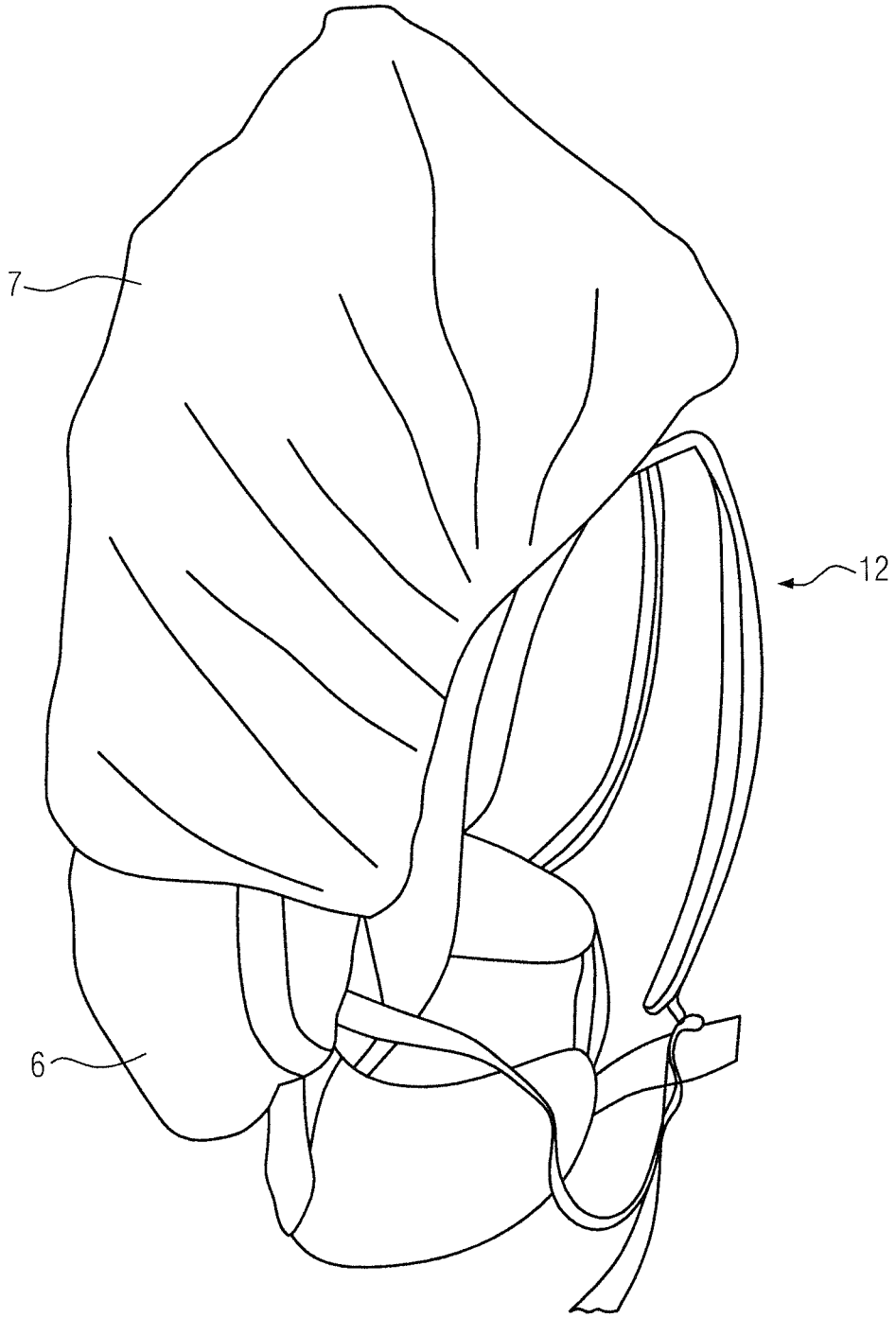
FIG. 5 shows a side view of the back pack according to the present subject matter with the rain cover mounted thereon.
Figure 6:
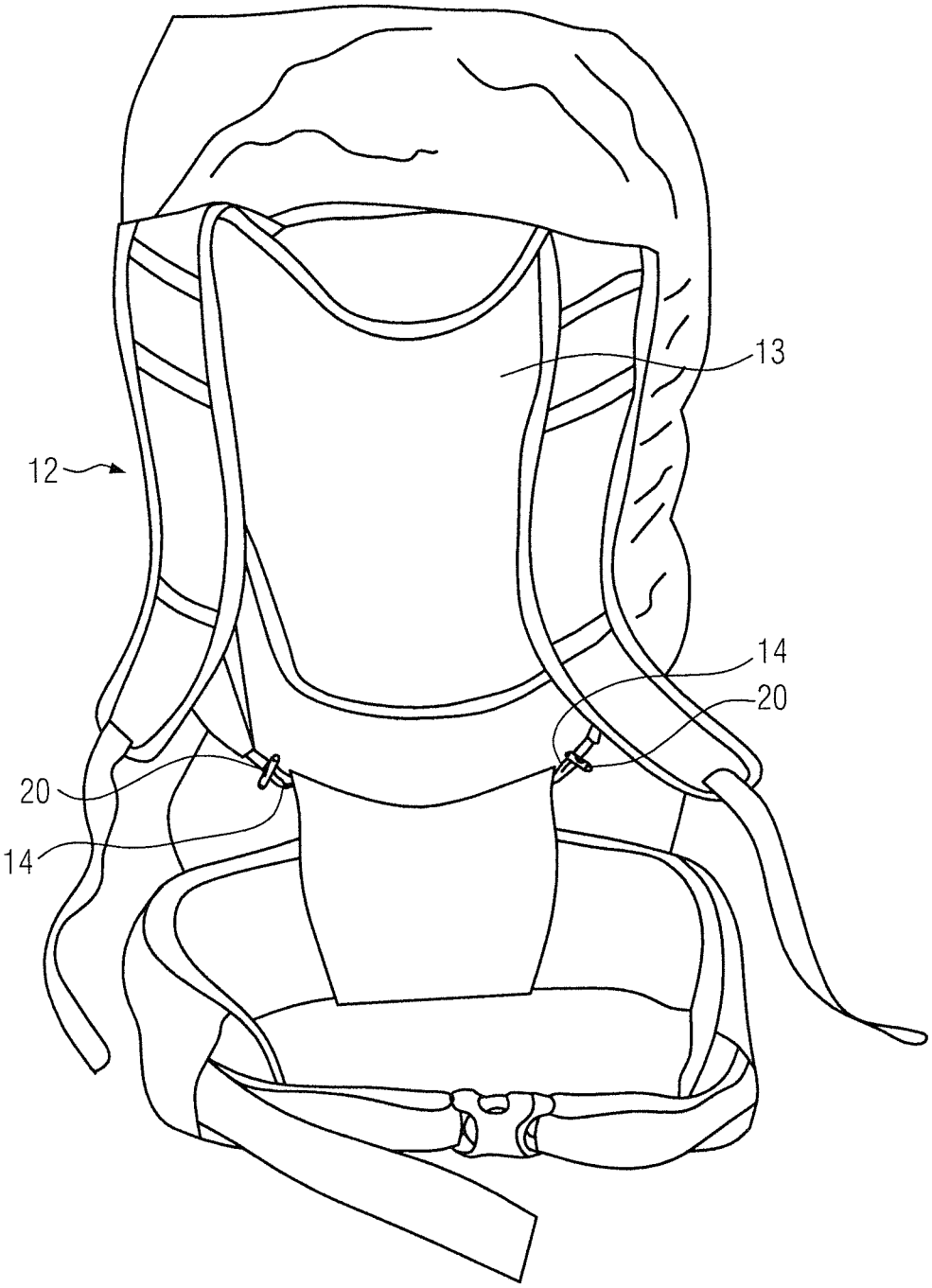
FIG. 6 shows a back side view of the back pack according to the present subject matter with the rain cover mounted thereon.

FIGS. 3 to 6 show conditions in which the rain cover is mounted on the back pack. FIG. 4 shows a front side view of the back pack 1 with the rain cover 7 mounted and it is shown that the rain cover 7 only covers an upper portion of the back pack 1. In other words, the lower part of the back pack is not covered by the rain cover 7. The lower part of the back pack 1 as shown in FIG. 4 corresponds to a waterproof base portion of the back pack. Since the base portion is waterproof, there is no need to cover this portion with the rain cover 7 and despite the rain cover 7 being mounted on the back pack 1, it is still possible to access further portions of the back pack 1 which in the present embodiment are ice axe loops 4 and side pockets 6. As is also shown in FIG. 4, the base portion of the back pack stands on the ground and since the base portion is waterproof, a wet or humid ground does not lead to the base portion being soaked so that it is prevented that water penetrates the back pack in the base portion. As it is shown in FIGS. 4 to 6, the mounted rain cover 7 fully covers the upper portion of the back pack 1 where the lid 2 is provided and ranges in the downward direction to a certain extent on the back side of the back pack 1.

A base portion of the rain cover 7 is provided with a reinforcement fabric 9 to provide a better fit, rigidity and durability. In FIG. 3, the lower portion of the rain cover 7 is shown inside out and the reinforcement fabric 9 is clearly visible. As is also shown in FIG. 3, the hooks 10 provided on the lower end of the rain cover are fixed to the rain cover 7 at the longitudinal end portions of the reinforcement fabric 9 so that the reinforcement fabric 9 extends all the way from one hook 10 to the other hook 10. In FIG. 3, it is also shown that the loops 11 provided on the back pack 1 are fixed in the rain cover compartment and are pulled out of the opening of the rain cover compartment for the fixation of the hooks 10.

FIG. 6 shows a back side view of the back pack 1 and in particular shows the way how the rain cover 7 is fixed in the mounted state. More precisely, two loops 14 are provided on the back side of the back pack and the hooks 20 as described above are coupled to the loops 14. As is shown in FIG. 6, the loops 14 are provided on both sides of a back panel 13 which rests on the back of a user when the back pack 1 is carried. Furthermore, the loops 14 are provided such that their accessibility between mounting portions of straps of the harness 12 is given. In the present embodiment, the loops 14 are provided at the lower portion of the back panel 13 near and above the hip belt 3. Furthermore, the back pack is shown in a state, in which the hooks 20 are hooked in the loops 14.

Figure 9:
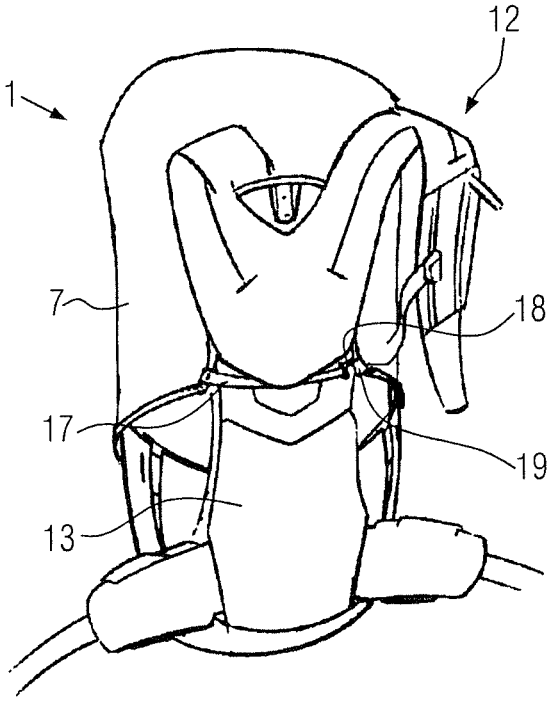
FIG. 9 shows an alternative configuration for mounting the rain cover on the back pack.

An alternative solution for mounting the rain cover on the back pack is shown in FIG. 9. In this solution, a strap 17 having a hook 18 at one end and being fixed to the rain cover 7 at the other end is used to fix the rain cover in the mounted state. More precisely, instead of the hooks 10 as shown in FIG. 6, the rain cover comprises the strap mounted on one side of the rain cover 7 and loop 19 mounted on the rain cover 7 such that it is located on the opposite side of the back panel 13 when the rain cover 7 is mounted on the back pack. As is shown in FIG. 9, the strap 17 is passed along the back panel 13 and the hook 18 is engaged with loop 19 so that the rain cover 7 is fixedly mounted on the back pack 1. In the alternative solution as shown here, the strap 17 is made from an elastic material providing an optimum fitting.

Figure 7:
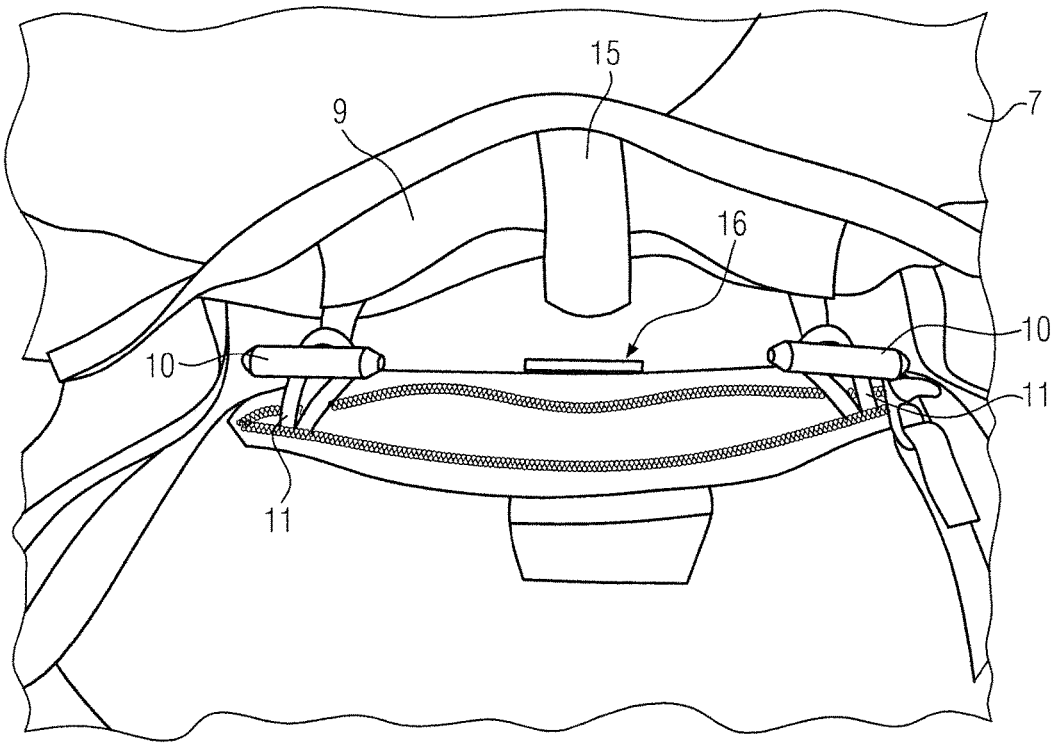
FIG. 7 shows an enlarged portion of a front side view of a further embodiment according to the present subject matter.
Figure 8:
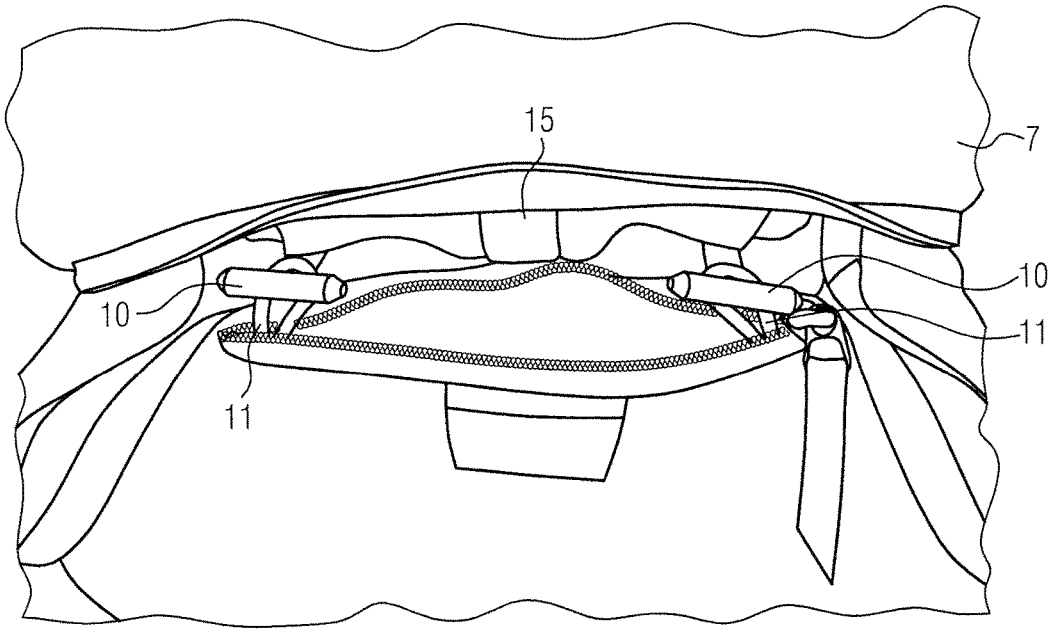
FIG. 8 shows a further front side view of an enlarged portion of the back pack according to the further embodiment.

A further embodiment is shown with respect to FIGS. 7 and 8. It is to be noted that the general construction of the second embodiment differs from the construction of the first embodiment only in that a reinforcement tab 15 made of plastic is provided in the base of the rain cover 7. As is shown in FIG. 7, this reinforcement tab is provided midways on the reinforcement fabric 9 and protrudes from the reinforcement fabric 9 in the downward direction in FIG. 7. A slit 16 which is provided above the zipped opening of the rain cover compartment forms an accommodating portion into which the protruding end of the reinforcement tab 15 can be inserted. FIG. 8 shows a condition, in which the protruding end of the reinforcement tab 15 is inserted into the slit 16. Due to the presence of the reinforcement tab 15 and the engagement of the protruding portion of the reinforcement tab 15 into the slit 16 in the mounted state of the rain cover 7, some extra rigidity is provided to the overall construction of the rain cover 7.

As regards the waterproof base portion, different ways are available for providing the waterproof characteristics. More precisely, it is possible to provide an internal waterproof lining in the base of the back pack which is mounted as an additional fabric in the lower portion of the inner compartment of the back pack 1. On the other hand, it is also possible to integrate the waterproof lining with the base fabric or to provide a fabric for the base portion which is itself waterproof.

The invention claimed is:

1. A back pack comprising:

a front side facing away from a user's back when said back pack is carried;

a back side facing towards said user's back when said back pack is carried;

a water proof base portion disposed at a lower end of a lengthwise direction of said front side of said back pack when said back pack is carried;

a rain cover compartment disposed at an upper end of said water proof base portion;

a rain cover adapted to be coupled to said rain cover compartment and cover more than half of said front side of said back pack in a mounted state such that at least portions of said back pack other than said water proof base portion are covered; and a harness attached to said back side of said back pack, said harness comprising a first strap and a second strap, wherein said first strap is attached at a lower portion and an upper portion of said back side of said back pack, and wherein said second strap is attached at said lower portion and said upper portion of said back side of said back pack.

2. The back pack according to claim 1, wherein said rain cover is adapted to cover the back pack such that said water proof base portion is not covered or a majority of said water proof base portion is not covered.

3. The back pack according to claim 1, wherein said rain cover compartment on said front side is at most one fourth of the total height of said front side.

4. The back pack according to claim 1, wherein said rain cover is adapted to cover three fourths of said front side of said back pack.

5. The back pack according to claim 1, wherein said rain cover comprises a fastening device for mounting said rain cover, said fastening device comprising an elastic strip fixed to an edge of said rain cover at one end and having a hook on the other end, and a loop provided at another position of said rain cover edge, said elastic strip and said loop being provided on said rain cover such that for fastening said rain cover on said back pack, said elastic strip is laterally passable along said back side of said back pack and engageable with said hook.

6. The back pack according to claim 1, further comprising a hip belt.

7. The back pack according to claim 1, wherein said rain cover is configured to be secured to said back pack such that said user can access an interior of said back pack.

8. The back pack according to claim 7, wherein said interior is a side pocket.

9. The back pack according to claim 1, wherein said first strap is attached on one side of a longitudinal midline of said back pack, and wherein said second strap is attached on an opposite side of said longitudinal midline of said back pack.

10. The back pack according to claim 9, wherein said first strap and said second strap are discontiguous.

11. The back pack according to claim 1, wherein an opening of said rain cover compartment is provided on said front side of said back pack at an upper end of said water proof base portion.

12. The back pack according to claim 11, wherein said back pack further comprises rain cover fastening elements for coupling said rain cover to said back pack, at least two of said fastening elements being first rain cover fastening elements provided in said rain cover compartment at a predetermined distance from each other in the lateral direction of said back pack, wherein said rain cover comprises first fastening elements provided at an edge of said rain cover at a distance from each other and engageable with the first rain cover fastening elements.

13. The back pack according to claim 12, wherein said rain cover comprises a reinforcement portion extending between said first fastening elements along the edge of said rain cover and wherein a reinforcement fabric sewn to said rain cover on a side facing towards said front side of said back pack when said rain cover is mounted on the back pack.

14. The back pack according to claim 13, wherein said reinforcement portion further comprises a reinforcement tab made of plastic, said reinforcement tab being provided substantially at the center of said reinforcement portion in an extension direction thereof and protruding from said reinforcement portion in a lateral direction of said reinforcement portion, wherein a protruding end of said reinforcement tab is insertable into an opening provided in the front side of said back pack, said opening being preferably arranged outside said rain cover compartment and adjacent to an opening of said rain cover compartment.

15. The back pack according to claim 12, wherein said fastening elements comprise elements of a hook and loop fastener, wherein said fastening elements of said rain cover comprise hooks and said fastening elements on said back pack preferably comprise loops.

16. The back pack according to claim 12, wherein said rain cover fastening elements are configured to be disposed on an edge of said rain cover.

17. The back pack according to claim 12, wherein said back pack further comprises second rain cover fastening elements provided on said back side at laterally spaced portions of said back pack and said rain cover comprises second fastening elements engageable with said second rain cover fastening elements.

18. The back pack according to claim 17, wherein said second rain cover fastening elements are disposed on both sides at a lower portion of a back panel configured to rest on said user's back when said back pack is in said mounted state.

19. The back pack according to claim 17, wherein said second rain cover fastening elements are configured to be accessible between mounting portions of said first and second straps of said harness.

20. A back pack comprising:

a front side facing away from a user's back when said back pack is carried;

a back side facing towards said user's back when said back pack is carried;

a water proof base portion provided at a lower end of said front side of said back pack;

a rain cover compartment disposed at an upper end of said water proof base portion;

a rain cover adapted to be coupled to said rain cover compartment and cover more than half of said front side of said back pack in a mounted state such that at least portions of said back pack other than said water proof base portion are covered; and a harness attached to said back side of said back pack, wherein said rain cover is configured to be secured to said back pack such that said user can access an interior of said back pack separate from said rain cover compartment in said mounted state when said back pack is carried.

* * * * *